US010500130B2

(12) United States Patent
Cox et al.

(10) Patent No.: US 10,500,130 B2
(45) Date of Patent: Dec. 10, 2019

(54) COMBINED MOBILITY AND STABILITY APPARATUS

(71) Applicants: Bradley Cox, Stoneham, MA (US); Sonia Pasquale, Stoneham, MA (US)

(72) Inventors: Bradley Cox, Stoneham, MA (US); Sonia Pasquale, Stoneham, MA (US)

( * ) Notice: Subject to any disclaimer, the term of this patent is extended or adjusted under 35 U.S.C. 154(b) by 812 days.

(21) Appl. No.: 15/089,127

(22) Filed: Apr. 1, 2016

(65) Prior Publication Data

US 2016/0317387 A1 Nov. 3, 2016

Related U.S. Application Data

(60) Provisional application No. 62/141,592, filed on Apr. 1, 2015.

(51) Int. Cl.
*A61H 39/04* (2006.01)
*A61H 7/00* (2006.01)

(52) U.S. Cl.
CPC ..... *A61H 39/04* (2013.01); *A61H 7/001* (2013.01); *A61H 2201/0126* (2013.01); *A61H 2201/1284* (2013.01); *A61H 2201/168* (2013.01); *A61H 2201/1695* (2013.01)

(58) Field of Classification Search
CPC .. A61H 2201/01034; A61H 2201/1238; A61H 2201/1284; A61H 2201/165; A61H 2201/5007; A61H 2201/5058; A61H 2201/5061; A61H 2201/5064; A61H 2201/5069; A61H 2205/106; A61H 2205/12; A61H 2230/207; A61H 2230/30; A61H 2230/50; A61H 2230/60; A61H 3/00; A61H 2003/007; A61H 39/04; A61H 7/001; A61H 2015/0042; A61H 2015/0092; A63B 21/0085; A63B 21/4029; A63B 22/14–18; A63B 26/003; A47C 9/00; A61B 17/00
USPC ..... 482/27, 142, 146; 434/247; 601/134, 601/136, 138
See application file for complete search history.

(56) References Cited

U.S. PATENT DOCUMENTS 3,024,021 A * 3/1962 Coplin ..... A63B 21/0004 482/146
7,618,358 B2 * 11/2009 Traub ..... A63B 26/003 482/147
9,968,505 B2 * 5/2018 Leier ..... A63B 21/00054
2002/0068884 A1 * 6/2002 Alviso ..... A61H 7/001 601/1
2007/0054791 A1 * 3/2007 Langer ..... A63B 21/0004 482/146
2007/0117698 A1 * 5/2007 Adamson ..... A61H 1/0296 482/148
2009/0105620 A1 * 4/2009 Wolfe ..... A61H 7/001 601/135

(Continued)

*Primary Examiner* — Justine R Yu
*Assistant Examiner* — Matthew R Moon
(74) *Attorney, Agent, or Firm* — Law Office of Jerry Joseph, PLC; Jerry K. Joseph

(57) ABSTRACT

A combined mobility and stability device which includes a body member having a platform base formed at a first end and a pressure application member formed at an opposing second end, the body member having a flexion portion disposed between the platform base and the pressure application member, wherein the flexion portion is configured to allow the pressure application member to move with respect to the platform base.

14 Claims, 13 Drawing Sheets

(56) References Cited

U.S. PATENT DOCUMENTS

| | | | | |
|---|---|---|---|---|
| 2010/0285931 | A1* | 11/2010 | Heller | A63B 22/18 482/92 |
| 2011/0028289 | A1* | 2/2011 | Jahns | A63B 23/0211 482/140 |
| 2012/0059405 | A1* | 3/2012 | Reynolds | A61H 23/02 606/204 |
| 2017/0231851 | A1* | 8/2017 | Faussett | A61H 15/00 601/135 |

* cited by examiner

COMBINED MOBILITY AND STABILITY APPARATUS

CROSS-REFERENCE

This application claims the benefit under 35 U.S.C. § 119 (e) of U.S. Provisional Patent Application No. 62/141,592, filed on Apr. 1, 2015, the disclosure of which is incorporated herein by reference in its entirety.

BACKGROUND OF THE INVENTION

1. Field of the Invention

The present general inventive concept relates generally to a therapeutic tool, and more particularly, to a combined therapeutic tool for performing both mobility and stability therapeutic exercises.

2. Background

Myofascial trigger points, also referred to as trigger points, trigger sites, or muscle knots are hyper-irritable spots in the fascia surrounding skeletal muscles of an individual. These trigger points are associated with palpable nodules in taut bands of muscle fibers and cause pain due to adhesions which are fibrous bands that form in muscle and fascia, often as a result of injury during surgery.

During therapy, therapists apply various techniques in order to treat individuals having adhesions or muscle knots. These techniques typically require targeted application of pressure and/or force to specific trigger points of the individual. However, each technique requires a specifically designed therapeutic tool in order to access and apply the appropriate amount of pressure or force to the particular trigger point. For instance, therapeutic balls have been developed which allow therapists to apply direct pressure to the trigger points and different therapeutic tools have also been developed to perform self-myofascial release. However, since therapeutic balls require the user to roll his or her muscles over the ball while the ball also moves, this therapeutic tool fails to provide a constant amount pressure to a specific target area on the individual.

Therefore, what is desired is a combined therapeutic tool which may be used to perform multiple therapeutic techniques, including active muscular re-patterning and deep tissue release, and various other massages.

BRIEF SUMMARY

The present general inventive concept provides an all-in-one or combined therapeutic tool which is designed and/or configured to be used for both mobility and stability therapeutic exercises.

The present general inventive concept also provides a combined therapeutic tool which includes a non-slip planar base at one end, a pressure or acupressure application portion at an opposite end, and a flexion portion disposed between the planar base and the pressure application portion. The flexion portion is designed and/or configured to allow the pressure application portion to flex and/or move side to side while the non-slip planar base remains stationary to apply a constant amount of pressure to a specific target area.

The present general inventive concept also provides a combined mobility and stability therapeutic tool which is designed and/or configured to provide constant deep pressure onto a tight, adhesioned or restricted muscle or trigger point.

The combined mobility and stability therapeutic tool allows a user to apply deep pressure to an adhesioned/restricted muscle or trigger point, while at the same time allowing the user to go through natural movement patterns of his muscles in order to strengthen opposing muscle groups and build stronger neuromuscular connectivity, thereby restoring the user's tissue elasticity. This is an effective method of eliminating pain that originates rom a trigger point and restoring normal muscular functioning.

The foregoing and/or other aspects of the present general inventive concept may be achieved by providing a combined mobility and stability device which includes a body member having a platform base formed at a first end and a pressure application member formed at an opposing second end, the body member having a flexion portion disposed between the platform base and the pressure application member, wherein the flexion portion is configured to allow the pressure application member to move, bend, and/or flex with respect to the platform base.

The body member may be formed from a silicone material.

The body member may be formed from a material having a durometer value between about 5 Shore A and about 50 Shore A. The material may have a durometer value of about 15 Shore A.

The material may have a durometer value of about 35.

The platform base may be formed with a planar surface configured to support the body member against a flat surface.

The body member may be formed with or coupled to a friction increasing material or coating to reduce slippage and to detachably secure the platform base to a desired surface.

The pressure application may be sized and shaped to correspond to an acupressure point.

The pressure application may be formed in a dome shape.

The flexion portion may allow the pressure application member to bend upto 45 degrees with respect to an axis (e.g., horizontal) of the body member.

The flexion portion may allow the pressure application member to perform mobility and stability exercises on a user's target areas.

The foregoing and/or other aspects of the present general inventive concept may be achieved by also providing a method of using a combined mobility and stability device including a body member having a platform base formed at a first end and a pressure application member formed at an opposing second end, the body member having a flexion portion disposed between the platform base and the pressure application member, the method includes placing a platform base of a first combined mobility and stability device on a surface, placing a platform base of a second combined mobility and stability device adjacent to the first combined mobility and stability device, placing a user's target area within a region defined by the pressure application member of the first combined mobility and stability device and the pressure application member of the second combined mobility and stability device, and performing mobility therapeutic exercises on the user's target area.

The method may further include flipping over the first and second combined mobility and stability devices.

The method may further include performing stability and mobility therapeutic exercises on the user's target area.

Additional features and embodiments of the present general inventive concept will be apparent from the following detailed description, drawings, and claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
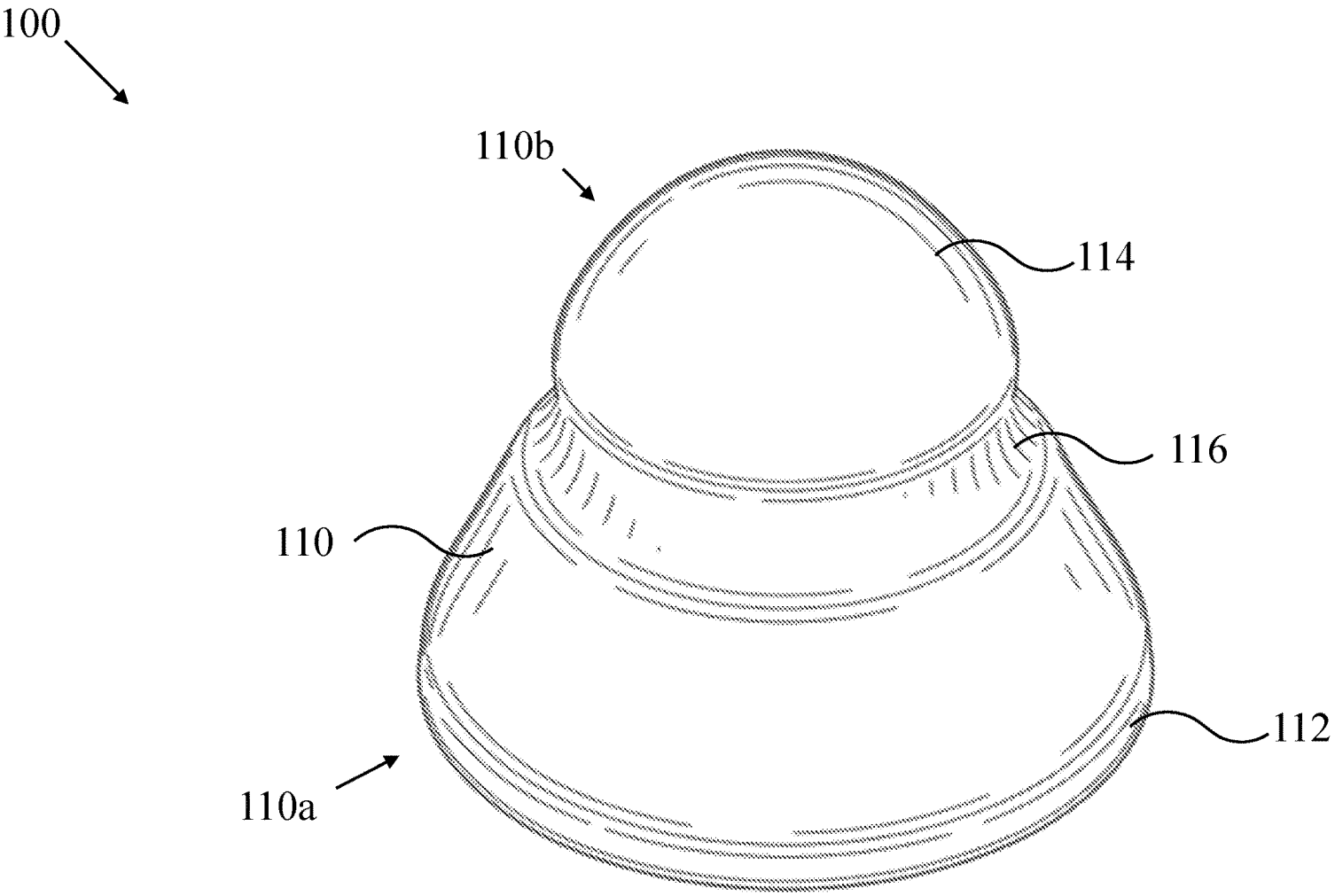
FIG. 1 is a front perspective view illustrating a combined mobility and stability therapeutic device according to an exemplary embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and methods described herein. Accordingly, various changes, modification, and equivalents of the structures and methods described herein will be suggested to those of ordinary skill in the art. The progression of method operations described are merely examples, however, and the sequence type of operations is not limited to that set forth herein and may be changed as is known in the art, with the exception of operations necessarily occurring in a certain order. Also, description of well-known functions and construction methods may be simplified and/or omitted for increased clarity and conciseness.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity may be repeated, any activity may be performed by multiple entities, and/or any element may be duplicated. In addition, the sizes and/or shapes of the various structures and elements may vary in order to perform specific therapeutic exercises, as desired.

The present general inventive concept provides a combined mobility and stability therapeutic device, which may be used for mobility, stability, and/or recovery enhancement exercises. The combined mobility and stability therapeutic device according to the present general inventive concept includes a stable platform base at a first end to stably rest on a flat surface and a pressure application to apply a force on a user at a second end. The platform base provides a stable platform from which a plurality of exercises, including active muscular re-patterning and deep tissue release, therapeutic movements, and various other massages may be performed on a user using the pressure application end. These exercises and techniques are designed to release muscular restrictions, increase tissue elasticity and at the same time promote and strengthen natural movement patterns. However, the present general inventive concept is not limited thereto.

The combined therapeutic device according to the present general inventive concept also provides a dual purpose therapeutic tool which allows users to seamlessly move between mobility and stability exercises, thereby increasing the users athletic performance and allowing for significantly improved and efficient rehabilitation and corrective exercises, in a reduced amount of time.

Figure 2:
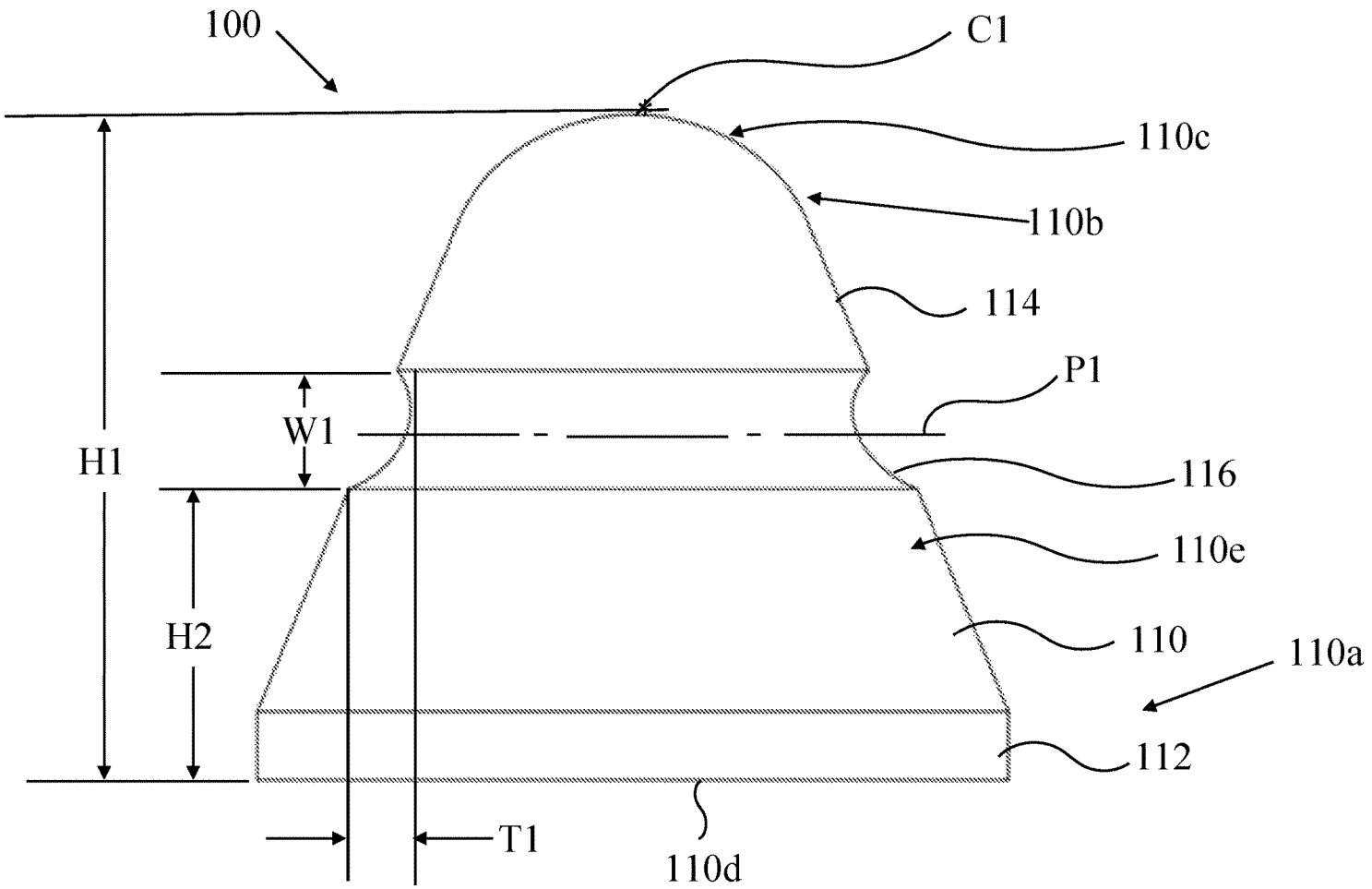
FIGS. 2-3 are front views of the combined mobility and stability therapeutic device illustrated in FIG. 1.
Figure 3:
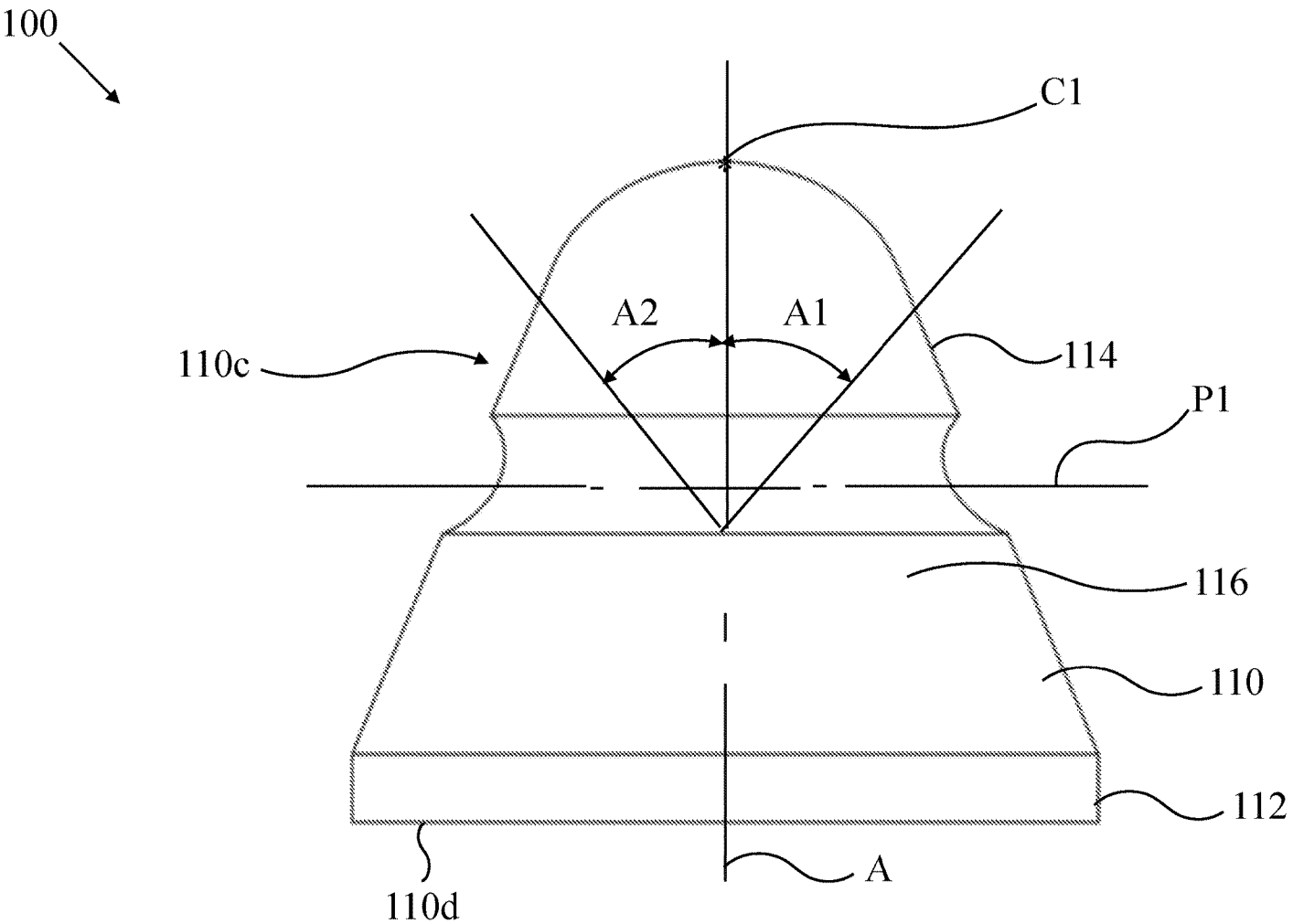
Figure 4:
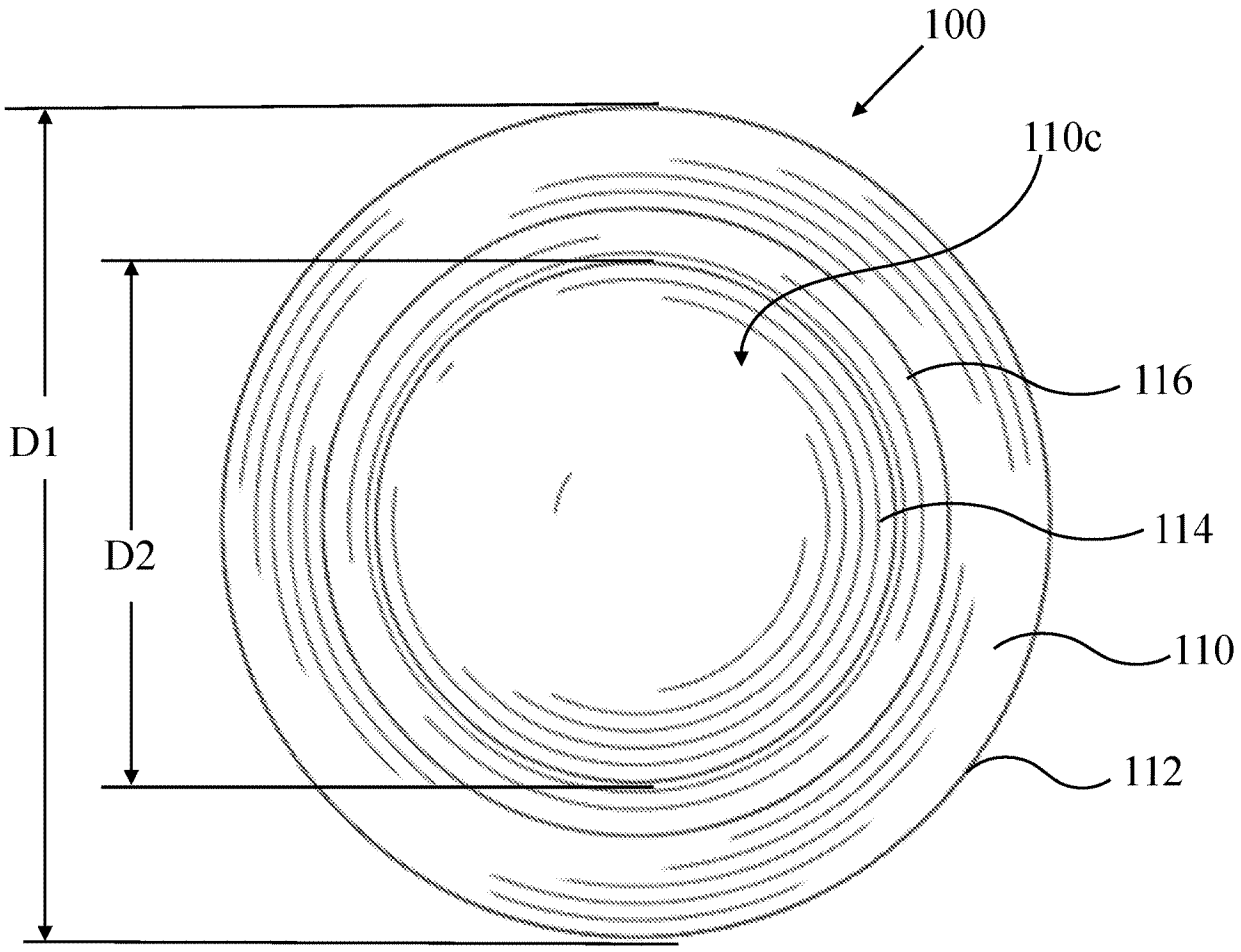
FIG. 4 is a top view of the combined mobility and stability therapeutic device illustrated in FIG. 1.

FIG. 1 is a front perspective view illustrating a combined mobility and stability therapeutic device 100 according to an exemplary embodiment of the present general inventive concept. FIGS. 2-3 are front views of the combined mobility and stability therapeutic device 100 illustrated in FIG. 1. FIG. 4 is a top view of the combined mobility and stability therapeutic device 100 illustrated in FIG. 1.

Referring to FIGS. 1-4, the combined mobility and stability therapeutic device 100 according to the present example embodiment includes a body member 110 having a platform base 112 formed at a first end 110*a* and a pressure application member 114 formed at an opposing second end 110*b*. The body member 110 further includes a flexion portion 116 formed between the first end 110*a* and the second end 110*b* which allows the pressure application member 114 to deflect, flex and/or move with respect to the platform base 112.

Referring to FIG. 2, the body member 110 includes a top surface 110*c*, a bottom surface 110*d*, and a sidewall surface 110*e* between the top and bottom surfaces 110*c*, 110*d*. The top surface 110*c* forms the rounded or dome-shaped pressure application member 114 and may be used to apply a pressure and/or force to a desired target area of the user's body. The bottom surface 110*d* of the body member 110 forms the planar surface of the platform base 112 and may be placed on the floor or against a wall, while a user presses a target area of the user's body against the dome-shaped pressure application member 114.

The combined mobility and stability therapeutic device 100 according to the present general inventive concept is designed and/or configured to be a dual purpose soft tissue combined mobility and stability therapeutic device. The combined mobility and stability therapeutic device 100 further allows for an individual to use the pressure application member 114 to provide consistent deep pressure into a tight, adhesed, and/or restricted muscle or trigger points by placing the platform base 112 against either the floor or a wall.

The combined mobility and stability therapeutic device 100 provides both a stable and unstable platform from which a user or patient may perform active muscular re-patterning exercises as well as deep tissue release, using the same therapeutic device 100.

In the present example embodiment, the body member 110 may be formed of a silicone material. However, the present general inventive concept is not limited thereto. That is, in alternative example embodiments, the body member 110 may be formed, molded, and/or constructed of a resilient and/or non-resilient material having sufficient friction to allow the platform base 112 to grip on to the floor or wall without moving when the user applies a force onto the pressure application member 114. In the present example embodiment, the outer sidewalls 110*e* of the body member 110 may be designed to allow a user to easily hold, grip, control, and/or manipulate the pressure application member 114 toward a desired target area on a user.

In the present example embodiment, the flexion portion 116 may be formed with the body member 110 to allow the pressure application member 114 to isolate and maintain a constant amount of pressure and/or force onto specific target areas deep in the muscle of the user's body. The flexion portion 116 may consist of cutouts or reliefs formed in various sizes and shapes around an outer surface of the sidewalls 110*e* of the body member 110 and may have a pivot axis P1. In the present example embodiment, the pressure application member 114 may pivot, flex, and/or move about the pivot axis P1.

Referring to FIG. 2, the combined mobility and stability therapeutic device 100 may have an overall height H1 of about 1 to 12 inches. The relief cutout of the flexion portion 116 may have a width W1 of approximately 1 inch, and may be disposed at a height H2 of about 1.25 from the bottom surface 110*d*. However, the present general inventive concept is not limited thereto. That is, the cutout portion may be formed in various sizes and/or shapes to provide various amount of deflection as desired for various therapeutic exercises or techniques.

The ability of the pressure application member 114 to flex and/or move about the pivot axis P1 relative to the platform base 112 allows the pressure application member 114 to apply a controlled and isolated amount of pressure and/or force to the specific target areas of the user. This controlled and isolated pressure allows the user to fire and release his or her muscles, while the muscles are being pressed against the combined mobility and stability therapeutic device 100, thereby neurologically retraining the muscles to move more efficiently.

Referring to FIGS. 3 and 4, in the present example embodiment, the body member 110 may be formed in a conical or frusta-conical shape having a substantially planar platform base 112, a dome-shaped pressure (e.g., acupressure) application member 114, and a curved or arc-shaped flexion member 116 formed as a cut-out around a perimeter of the body member 110. The flexion portion 116 may further be designed to allow a user to easily hold and/or grip the body member 110 while the combined mobility and stability therapeutic device 100 is used during mobility, stability, and/or recovery enhancement exercises.

In the present example embodiment, the platform base 112 may be formed with a diameter D1 between about 2 to 12 inches, the pressure application member 114 may be formed with a diameter D2 between about 1 to 11 inches, and the flexion member 116 may be formed with a cut-out thickness T1 of about 0.25 to 5 inches. However, the present general inventive concept is not limited thereto. That is, in alternative example embodiments, the base platform 112 may have a diameter D1 of about 3.5 inches and the pressure application member 114 may have a diameter D2 of about 1.5 inches.

In alternative exemplary embodiments, the diameters D1 and D2 and the height H1 may vary in order to accommodate different muscle groups and/or types of exercises. That is, the body member 110 may be formed in various sizes and/or shapes as desired to target specific areas (e.g., trigger points) of a user's body.

The flexion portion 116 allows the pressure application member 114 to deflect with respect to the base platform 112 when a force (i.e., F1 or F2) is applied onto the pressure application member 114. In particular, contact point C1 on the pressure application member 114 maintains direct contact with a desired target point of the user, even during movement of the user. The flexion portion 116 allows the pressure application member 114 to deflect at an angle A1 (between 0 and 45 degrees) toward a first side and at an angle A2 (between 0 and 45 degrees) toward a second side.

In exemplary embodiments, the combined mobility and stability therapeutic device according to the present general inventive concept includes a non-slip texture or similar material coated on the base so that the pressure application end may maintain consistent contact with the user, without the stable platform base moving or rolling away from a desired point of contact C1 on the user. For instance, a sticky pad or friction increasing type material may be attached, coupled to, or integrally formed with the bottom surface of the platform base to provide increased friction to thereby secure the combined mobility and stability therapeutic device to a desired surface.

The present general inventive concept further provides a combined therapeutic device which includes a non-slip planar platform base formed at one end (e.g. a first end), a pressure application portion formed in a rounded shape at an opposite end (e.g., a second end), and a flexion portion disposed between the first end and the second end which is designed and/or configured to allow the pressure or acupressure application portion to flex and/or move side to side, while allowing the non-slip platform base to remain stationary. However, the present general inventive concept is not limited thereto.

That is, in alternative example embodiments, the flexion portion of the combined mobility and stability therapeutic device may be disposed internally within the stable platform base which allows the pressure application end to move with a desired contact point on the user, while maintaining a constant pressure on the user. The combined mobility and stability balance therapeutic device (i.e., combined therapeutic tool) according to the present general inventive concept includes a stable base platform which may be pressed against a planar surface, such as a floor or wall, in order to support the pressure application portion when applying a direct pressure and/or force onto desired target areas on a user's body using the pressure application portion. The combined mobility and stability therapeutic device may be placed on the ground or against a wall while a person applies pressure to his or her restricted muscles while moving his or her body part against the pressure application portion, contracting and releasing the muscle. As such, the combined mobility and stability therapeutic device may thereby maintain constant contact on the restricted muscle, while the person moves. That is, the combined mobility and stability therapeutic device is designed to make sure that the base platform stays in place, while a person moves over the top of the pressure application portion.

The combined therapeutic device may be used to perform multiple therapeutic techniques and exercises on the user including active muscular re-patterning, deep tissue release, and recovery enhancement exercises, as well as various other therapeutic movements and massages. However, the present general inventive concept is not limited thereto.

In the present example embodiment, the combined therapeutic device is designed to allow a therapist to perform multiple exercises and/or techniques on a user using the same device, without needing to use a different therapeutic tool for each technique or to access various trigger points.

In the present example embodiment, when positioned in a first orientation, the combined therapeutic device provides a stable platform from which a plurality of exercises designed to release muscular restrictions, increase tissue elasticity, and at the same time promote and strengthen natural movement patterns may be self-performed by the user or by the therapist on the user. However, when positioned in a second orientation, the combined therapeutic device provides an un-stable platform from which the plurality of exercises may be self-performed by the user or by the therapist on the user.

That is, when the combined therapeutic device is positioned in the first orientation, the platform base is placed against a planar surface or wall and the combined therapeutic device provides a stable platform from which to perform the plurality of exercises. Conversely, when the combined therapeutic device is positioned in the second orientation, the rounded pressure application portion is placed against the planar surface or wall, and the combined therapeutic device provides an unstable surface from which to perform a plurality of exercises to increase proprioceptive awareness and muscular activation.

Figure 5:
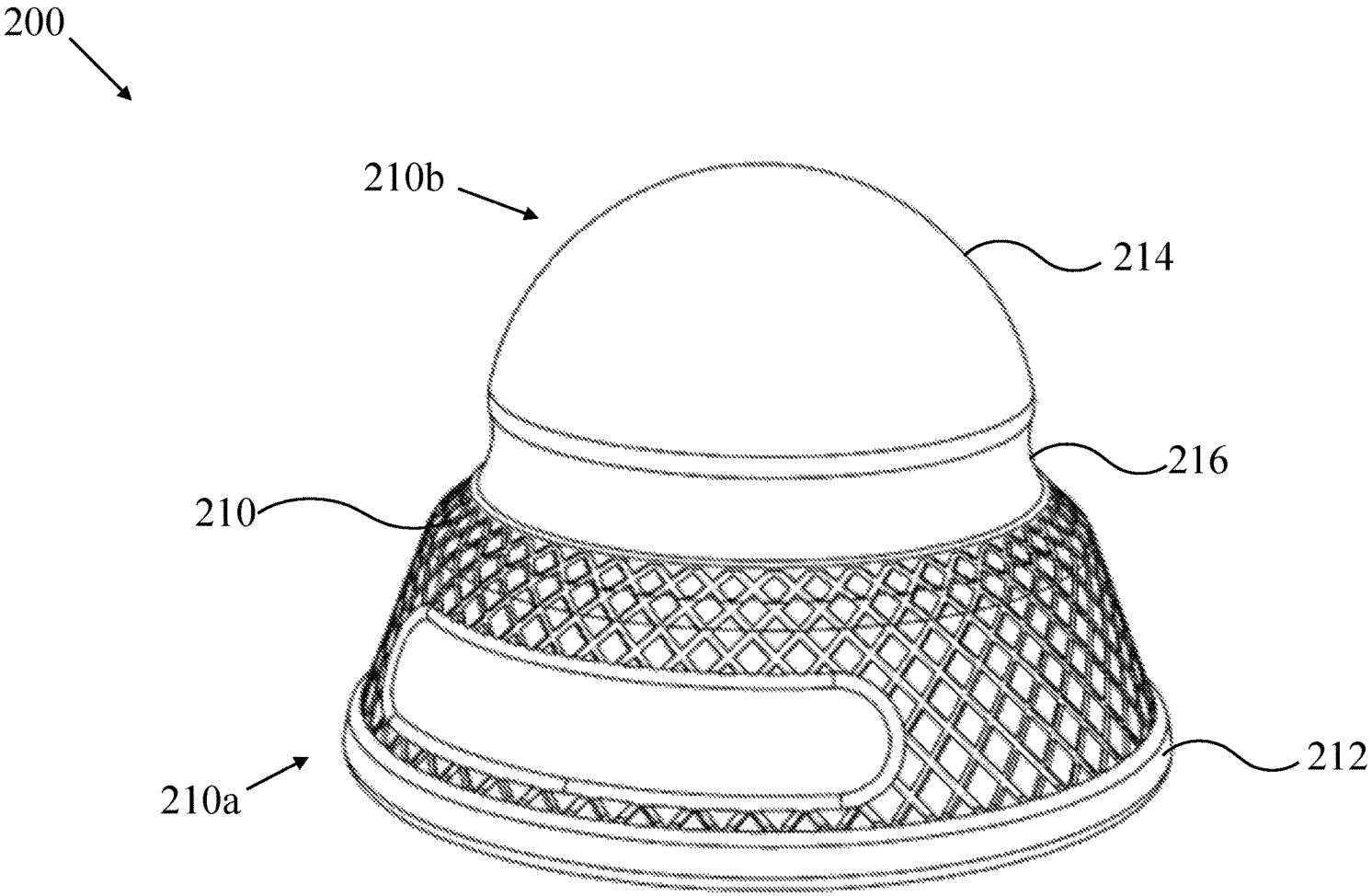
FIG. 5 is a front perspective view of a combined mobility and stability therapeutic device according to another example embodiment of the present general inventive concept.
Figure 6:
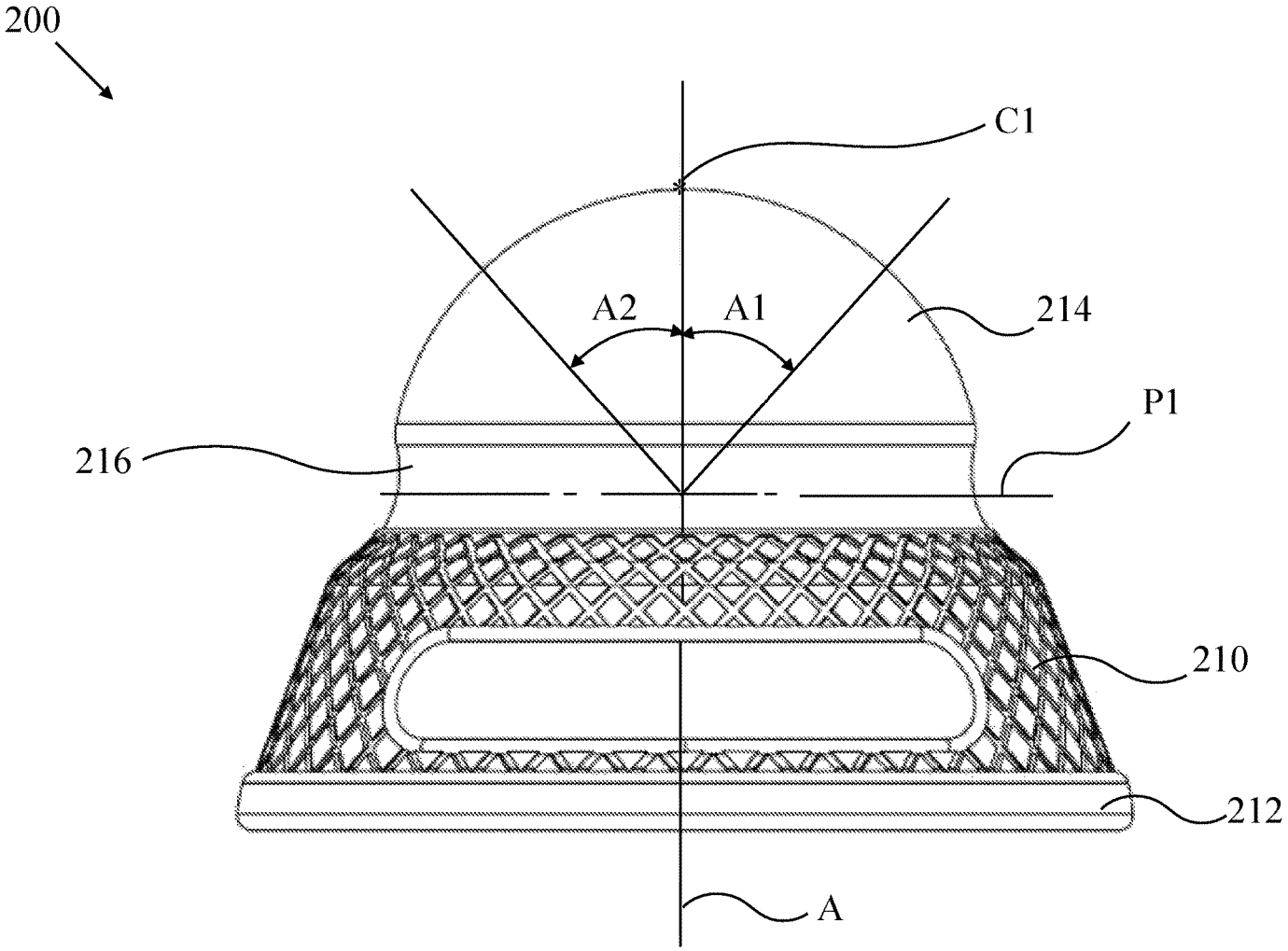
FIG. 6 is a front view of the combined mobility and stability therapeutic device illustrated in FIG. 5.

FIG. 5 is a front perspective view of a combined mobility and stability therapeutic device 200 according to another example embodiment of the present general inventive concept. FIG. 6 is a front view of the combined mobility and stability therapeutic device 200 illustrated in FIG. 5 and FIG. 7 is a top view of the combined mobility and stability therapeutic device 200 illustrated in FIG. 5.

Figure 7:
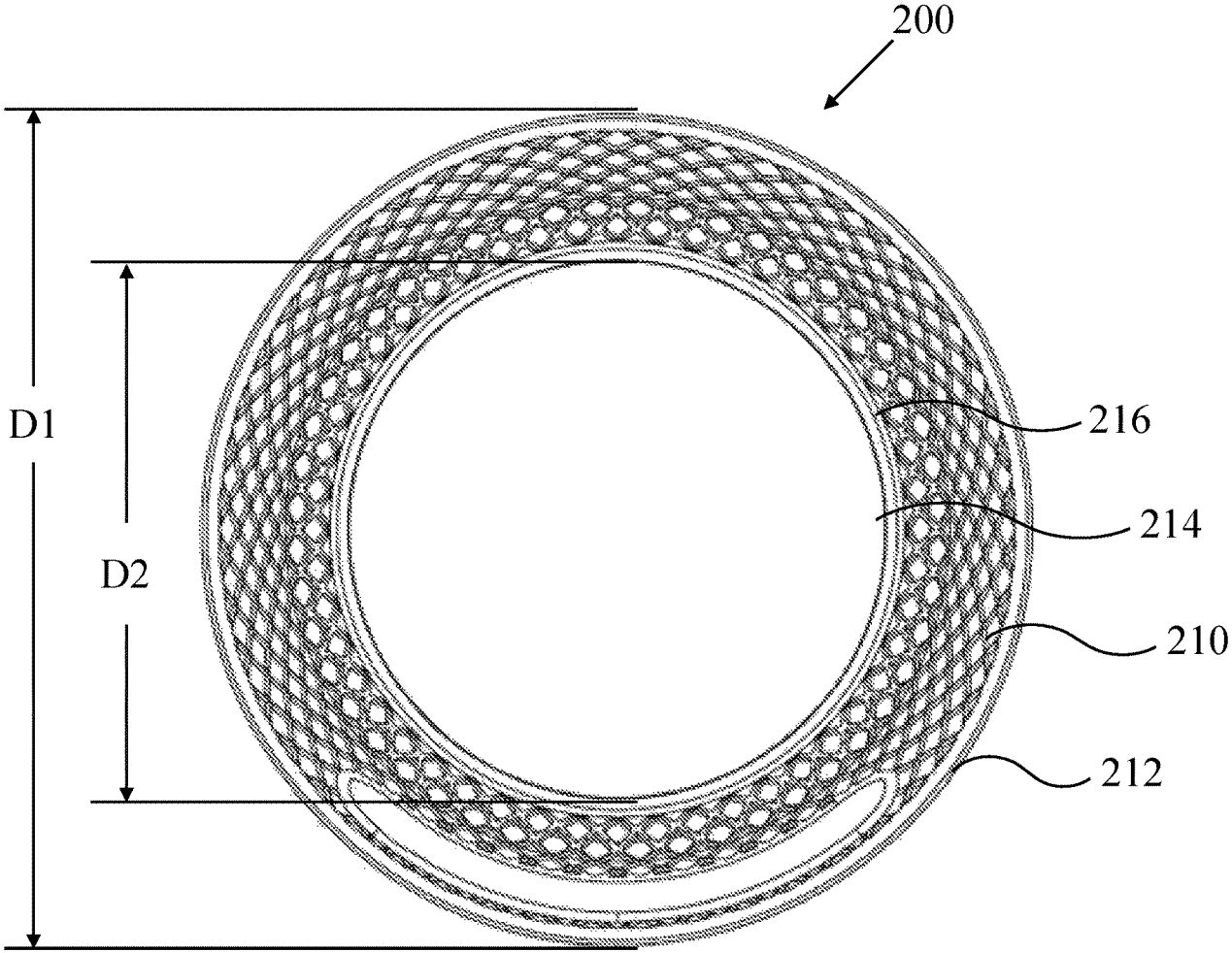
FIG. 7 is a top view of the combined mobility and stability therapeutic device illustrated in FIG. 5.

Referring to FIGS. 5-7, the combined mobility and stability therapeutic device 200 according to the present example embodiment includes a body member 210 having a platform base 212 formed at a first end 210*a* and a pressure application member 214 formed at an opposing second end 210*b*. The body member 210 further includes a flexion portion 216 formed around the body member 210 in between the platform base 212 and the pressure application member 214 to allow the pressure application member 214 to flex and/or move with respect to the platform base 212. The combined mobility and stability therapeutic device 200 according to the present example embodiment is similar to the previous example embodiment, except for the body member 210 further includes a grid pattern 213 on the side wall of the body member 210 to provide additional grip for a user to hold. As in the previous embodiments, the pressure application member 214 according to the present example embodiment may pivot, flex, and/or move about a pivot axis P1.

In addition, similar to the previous example embodiment, the flexion portion 216 allows the pressure application member 214 to deflect with respect to the base platform 212 when a force (i.e., F1 or F2) is applied onto the pressure application member 214. In particular, contact point C1 on the pressure application member 214 maintains direct contact with a desired target point of the user, even during movement of the user. The flexion portion 216 allows the pressure application member 214 to deflect at an angle A1 (between 0 and 45 degrees) toward a first side and at an angle A2 (between 0 and 45 degrees) toward a second side.

Figure 8:
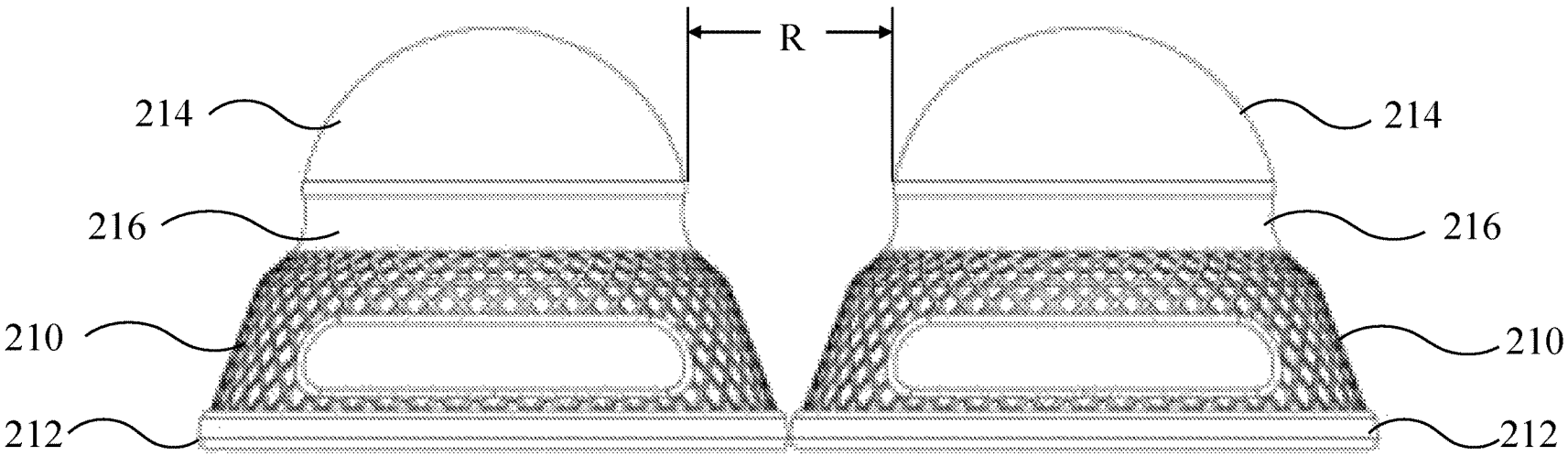
FIG. 8 is a front view of two combined mobility and stability therapeutic devices assembled according to an exemplary embodiment of a method of the present general inventive concept.
Figure 9:
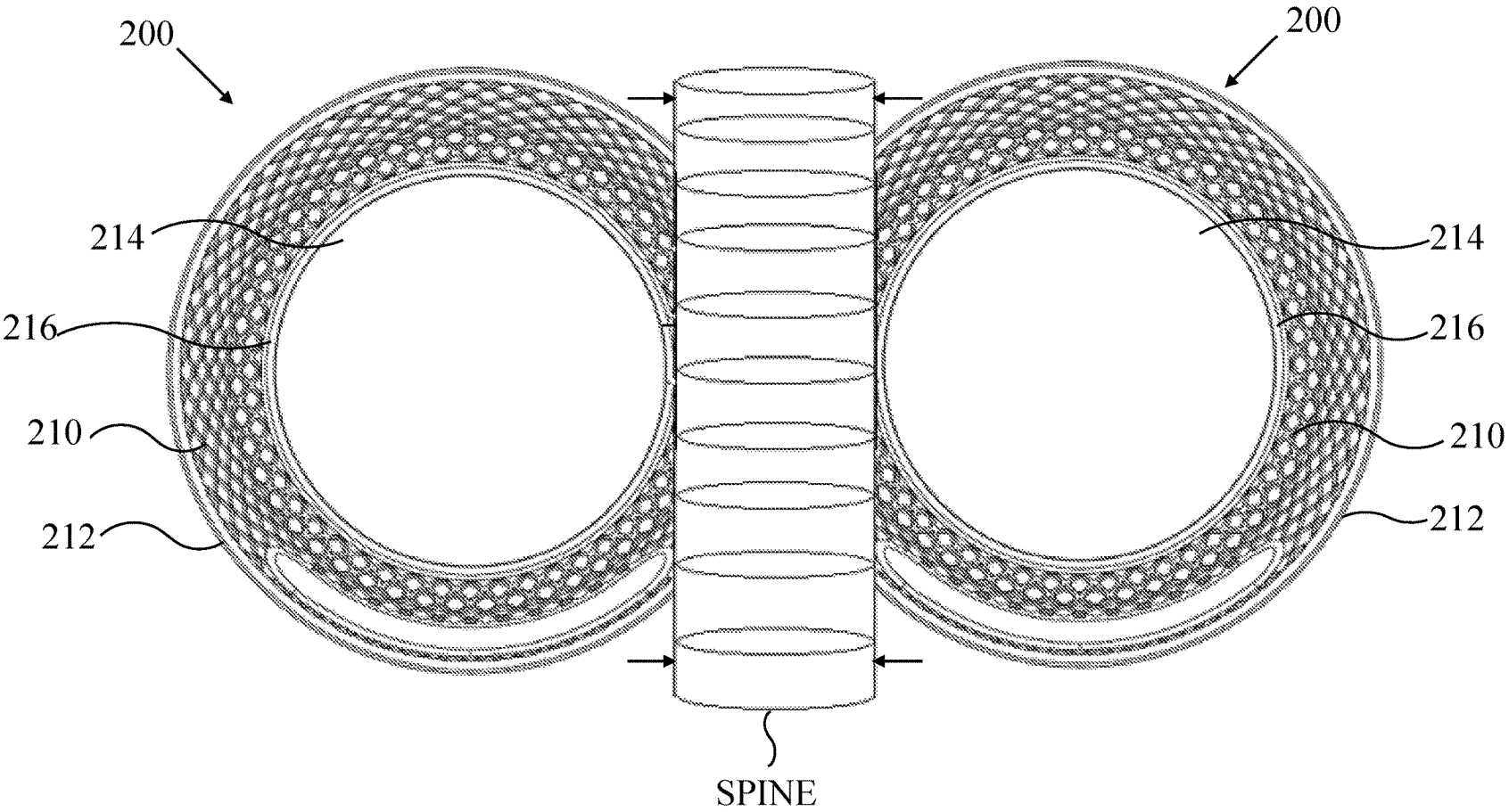
FIG. 9 is a top view of the two combined mobility and stability therapeutic devices illustrated in FIG. 8.

FIG. 8 is a front view of two combined mobility and stability therapeutic devices 200 assembled according to an exemplary embodiment of a method of using the combined mobility and stability device according to the present general inventive concept. FIG. 9 is a top view of the two combined mobility and stability therapeutic devices 200 illustrated in FIG. 8 applying a force to a user's spine.

A method of using a combined mobility and stability device according to an example embodiment of the present general inventive concept includes obtaining two combined mobility and stability therapeutic devices 200 which each include a body member 210 having a platform base 212 formed at a first end and a pressure application member 214 formed at an opposing second end, the body member 210 having a flexion portion 216 disposed between the platform base 212 and the pressure application member 214. The method includes placing the platform base 212*a* of a first combined mobility and stability device 200 on a surface and placing the platform base 212*b* of a second combined mobility and stability device 200 adjacent to the first combined mobility and stability device 200. The platform base 212*a* of the first mobility and stability device 200 may contact the platform base 212*b* of second mobility and stability device 200. The method further includes placing a user's target area (e.g., spine, muscles, or limbs) within a region R defined by the pressure application member 214*a* of the first combined mobility and stability device 200 and the pressure application member 214*b* of the second combined mobility and stability device 200 and then performing mobility therapeutic exercises on the user's target area using the pressure application members 214*a*, 214*b* of the first and second mobility and stability devices. In alternative example embodiments, the method may further include flipping over the first and second combined mobility and stability devices in order to perform stability therapeutic exercises on the user's target area.

Figure 10:
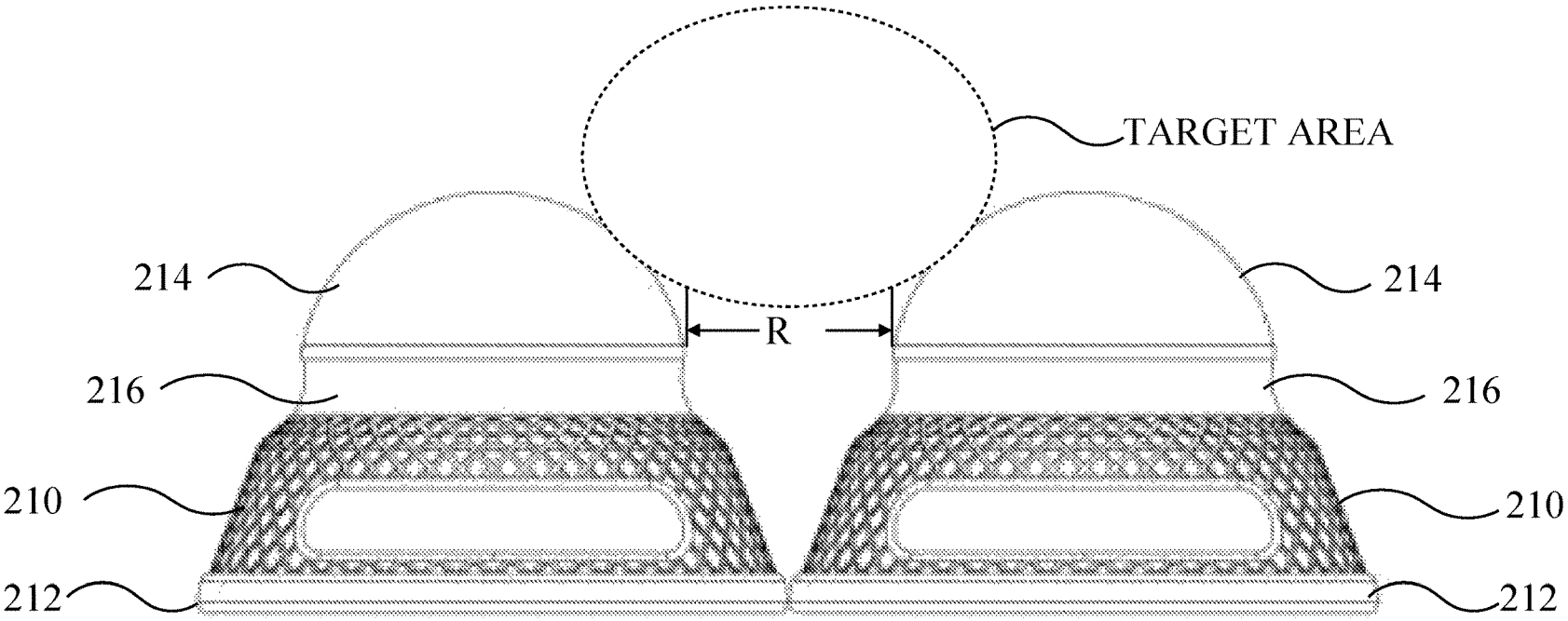
FIG. 10 is a front view of two combined mobility and stability therapeutic devices assembled according to another exemplary embodiment of a method of using the combined mobility and stability device according to the present general inventive concept.

FIG. 10 is a front view of two combined mobility and stability therapeutic devices 200 assembled according to another exemplary embodiment of a method of using the combined mobility and stability device to apply a compressive force to vise a user's muscles and/or limbs.

A method of using a combined mobility and stability device according to another example embodiment of the present general inventive concept includes obtaining two combined mobility and stability therapeutic devices as described in the previous example embodiment. The present method further includes placing a user's target area (e.g., muscles and or limbs) within a region R1 defined by the pressure application member of the first combined mobility and stability device and the pressure application member of the second combined mobility and stability device and then allowing the two combined mobility and stability devices to perform a vise or clamping action on the user's target area.

Figure 11:
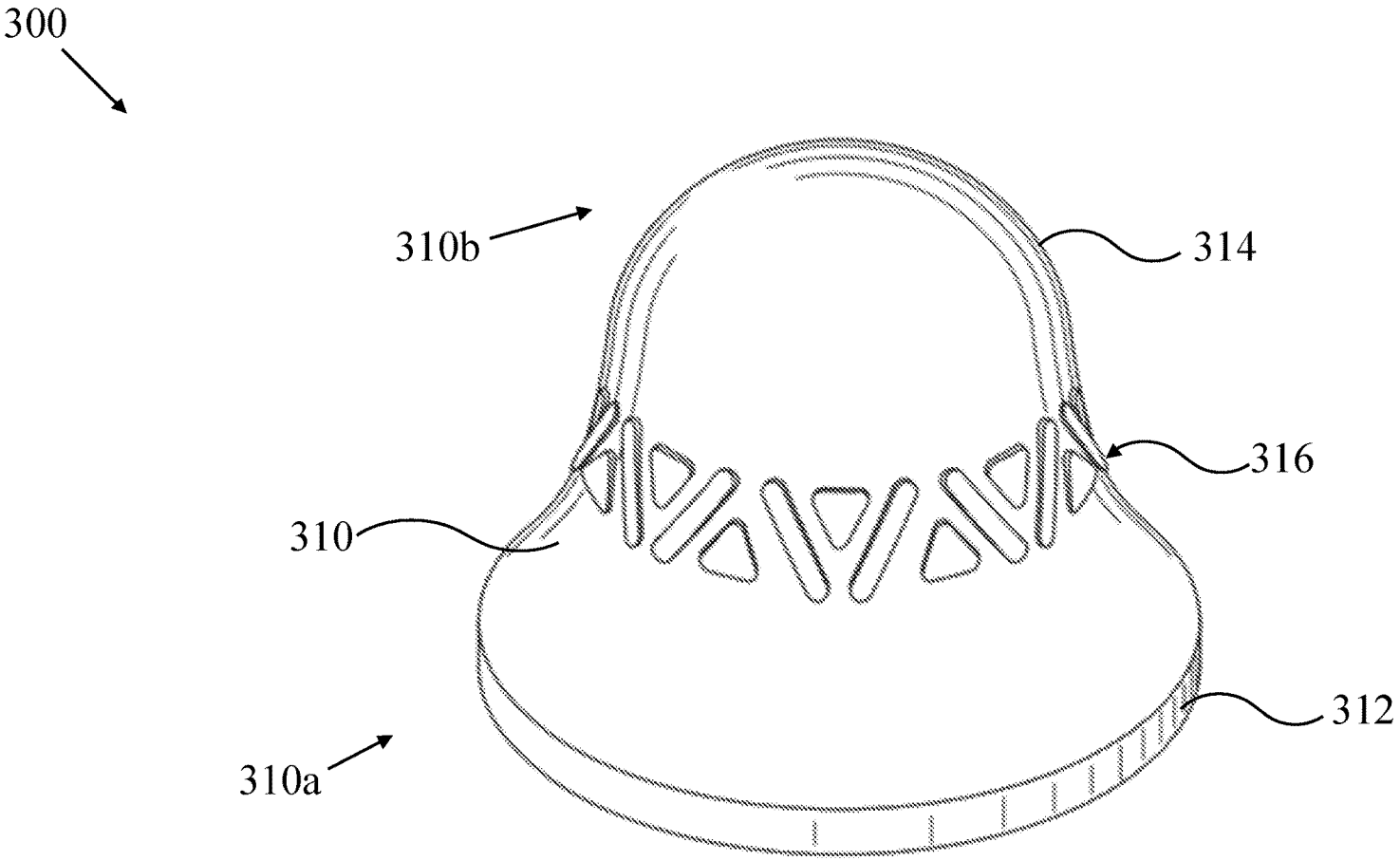
FIG. 11 is a front perspective view of a combined mobility and stability therapeutic device according to another example embodiment of the present general inventive concept.

FIG. 11 is a front perspective view of a combined mobility and stability therapeutic device 300 according to another example embodiment of the present general inventive concept.

Referring now to FIG. 11, the combined mobility and stability therapeutic device 300 according to the present example embodiment includes a body member 310 having a platform base 312 formed at a first end 310*a* and a pressure application member 314 formed at an opposing second end 310*b*. The body member 310 further includes a flexion portion 316 formed integrally on a surface of the body member 310 in between the platform base 312 and the pressure application member 314 to allow the pressure application member 414 to flex and/or move with respect to the platform base 312.

Figure 12:
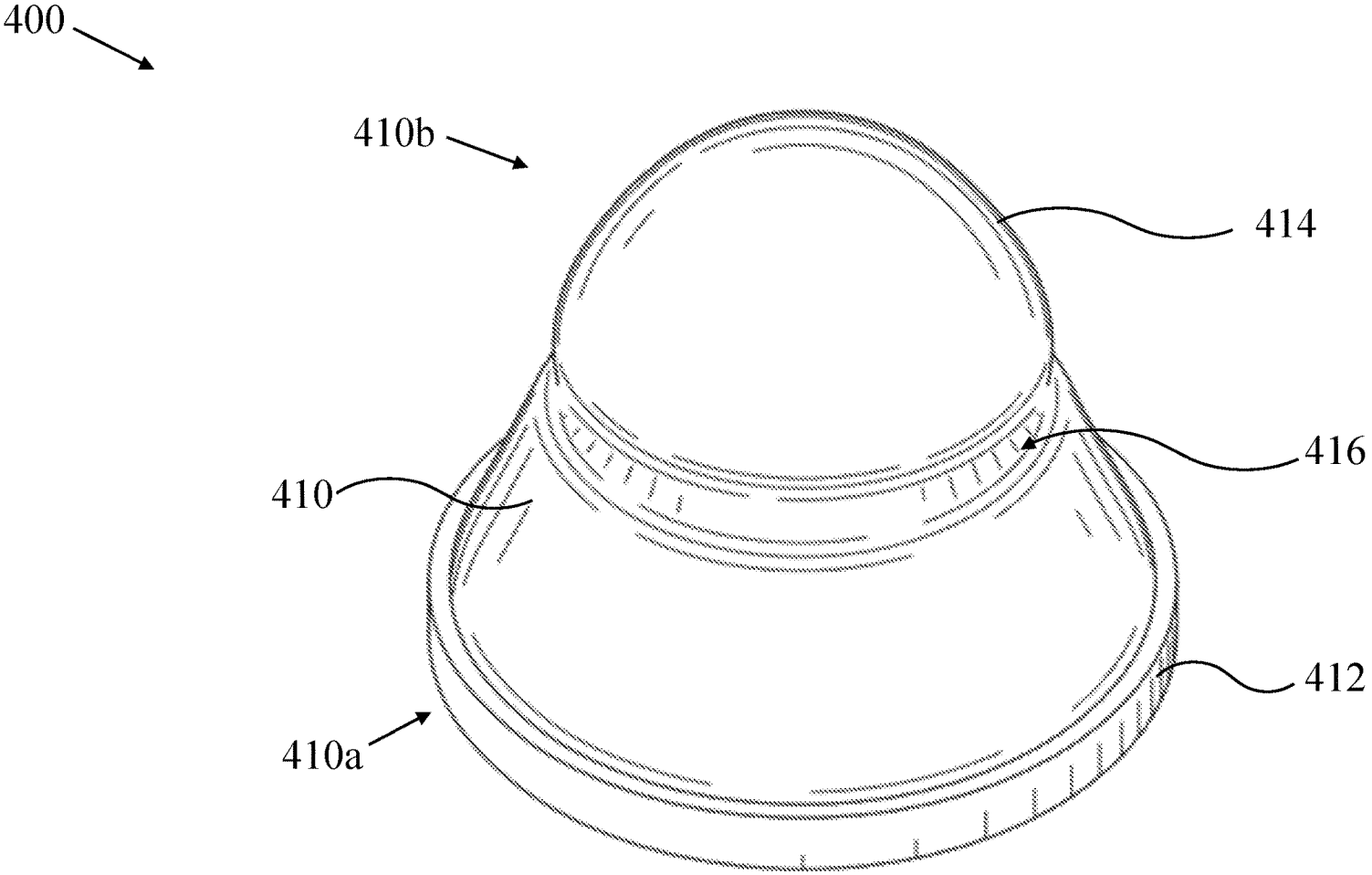
FIG. 12 is a front perspective view of a combined mobility and stability therapeutic device according to another example embodiment of the present general inventive concept.
Figure 12B:
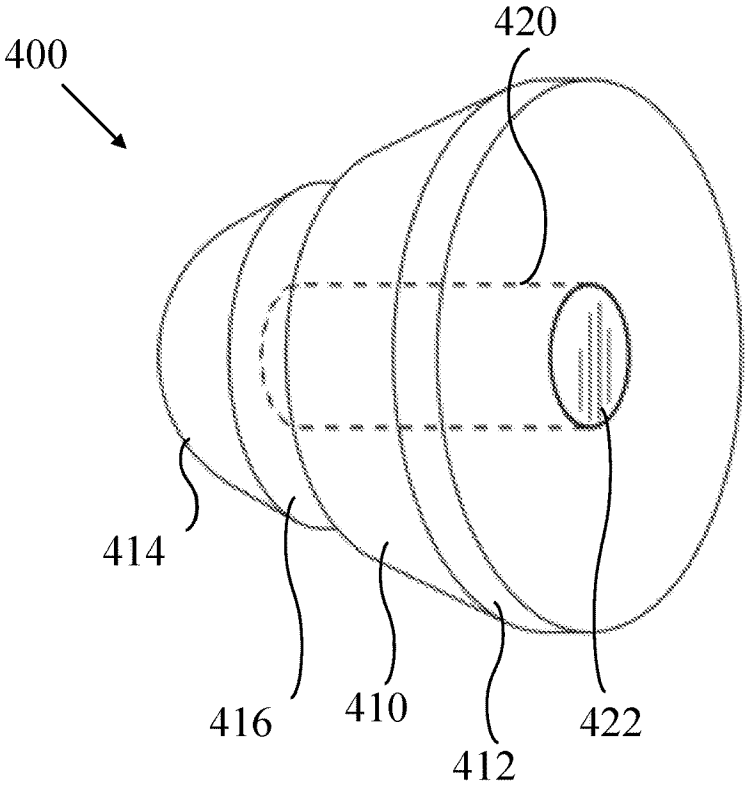
FIGS. 12A-B are bottom perspective assembly views of the combined mobility and stability therapeutic device illustrated in FIG. 12.
Figure 12A:
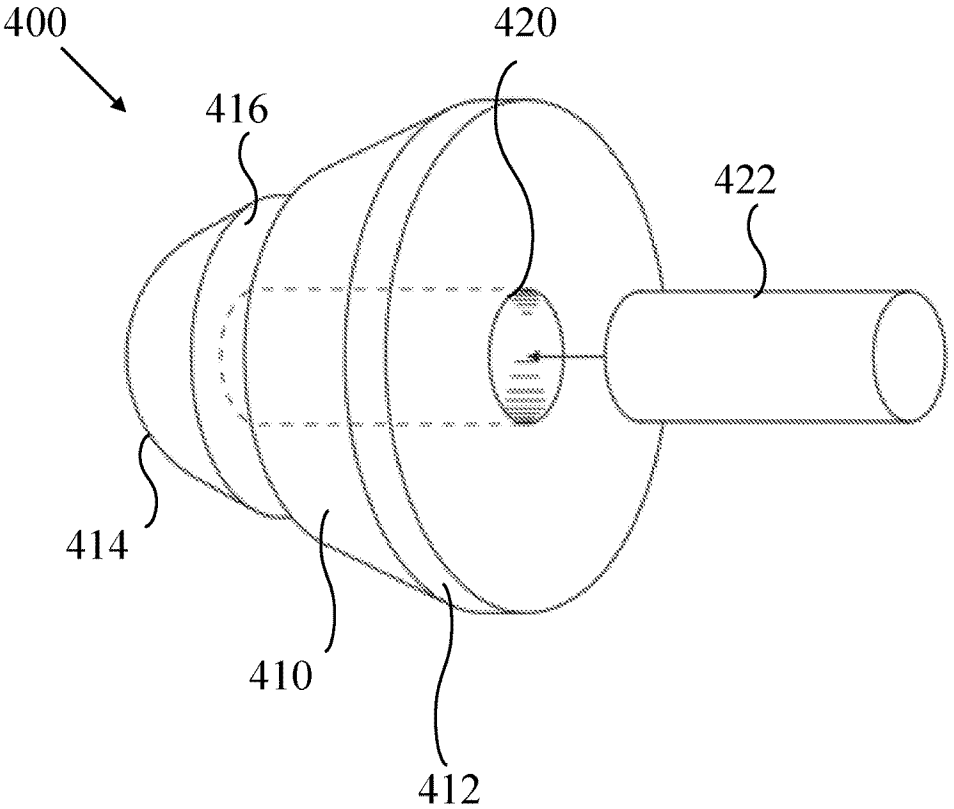

FIG. 12 is a front perspective view of a combined mobility and stability therapeutic device according to another example embodiment of the present general inventive concept. FIGS. 12A-B are bottom perspective assembly views of the combined mobility and stability therapeutic device illustrated in FIG. 12.

Referring now to FIG. 12, the combined mobility and stability therapeutic device 400 according to the present example embodiment includes a body member 410 having a platform base 412 formed at a first end 410*a* and a pressure application member 414 formed at an opposing second end 410*b*. The body member 410 includes a flexion portion 416 formed into a surface of the body member 410 and located in between the platform base 412 and the pressure application member 414 to allow the pressure application member 414 to flex and/or move with respect to the platform base 412. The combined mobility and stability therapeutic device 400 according to the present example embodiment is similar to the previous example embodiments, but further includes an attachment port 420 formed into the platform base 412, in which a plurality of attachment tools 422 may be removably attached. The plurality of attachment tools 422 may include a means for heating or cooling, a means for creating a vibration, a suction cup, an ergonomic grip, and a massage tool, and/or a magnetic field. However, the present general inventive concept is not limited thereto.

In the present example embodiment, the plurality of attachment tools 422 may include a vibration member (not illustrated) which may be formed of a material which may be heated and cooled, to thereby provide heat or cold to a user. For instance, the material will be designed to be heated within a microwave or hot bath in order to apply thermal therapy to the user. However, the present general inventive concept is not limited thereto.

In alternative example embodiments, the combined mobility and stability therapeutic device may be manufactured from a material suitable to being placed in a cold environment, such as a freezer, to thereby allow the combined mobility and stability therapeutic device to be used as a cool therapy tool for sore aching muscles.

The combined mobility and stability therapeutic device according to the present general inventive concept is designed to apply a controlled and constant amount of pressure and/or force onto an isolated target area of the user, while at the same time allowing the user to fire and release muscles with the isolated target area in order to increase the user's range of motion and the muscle's elasticity (i.e., active mobilization). As a result, the combined mobility and stability therapeutic device increases the user's muscle length, strength, and power, thereby improving the user' performance in a wide range of activities and less likely to suffer from injuries. However, the present general inventive concept is not limited thereto.

The combined mobility and stability therapeutic device according to the present general inventive concept may be used by various medical professionals and therapists. In addition, the combined mobility and stability therapeutic device may be self applied by the user.

The combined mobility and stability therapeutic device according to the present general inventive concept may further be embodied as a hand-held stability and balance ball having various sizes and/or shapes. In alternative example embodiments, the combined mobility and stability therapeutic device according to the present general inventive concept may be integrally formed in various therapeutic tools, such as mats, vests, belts, and/or various massage tools.

The combined mobility and stability therapeutic device according to the present general inventive concept may be formed with various materials having various durometers to provide a desired amount of pressure or a desired amount of deflection of the pressure application member. For instance, the combined mobility and stability therapeutic device may be formed with a softer durometers which may better suited for muscles on either side of a users spine and overly restricted muscles that are too tender for deeper pressure. Alternatively, the combined mobility and stability therapeutic device may be formed with a harder durometer which may better suited for applying greater and deeper muscle pressure.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A combined mobility and stability device, comprising:

a body member having a platform base formed at a first end and a semi-circular dome shaped pressure application member formed at an opposing second end, the platform base having a diameter between about 2 inches to about 12 inches, the body member having a flexion portion disposed on an outer surface of the body member between the platform base and the pressure application member, wherein the flexion portion includes a relief configured to allow the pressure application member to bend with respect to a pivot axis centered about the relief, the relief having a width of about 1 inch and a bottom of the relief disposed about 1.25 inches from the platform base.

2. The combined mobility and stability device of claim 1, wherein the body member is comprising a silicone material.

3. The combined mobility and stability device of claim 2, wherein the body member is comprising a material having a durometer value between about 5 and about 50.

4. The combined mobility and stability device of claim 3, wherein the material has a durometer value of about 15.

5. The combined mobility and stability device of claim 3, wherein the material has a durometer value of about 35.

6. The combined mobility and stability balance device of claim 1, wherein the platform base is formed with a planar surface configured to support the body member against a flat surface.

7. The combined mobility and stability device of claim 6, wherein the body member is formed with a friction coating to reduce slippage.

8. The combined mobility and stability device of claim 5, wherein the pressure application is sized and shaped to correspond to an acupressure point.

9. The combined mobility and stability device of claim 5, wherein the pressure application member is in a dome shape.

10. The combined mobility and stability device of claim 9, wherein the flexion portion allows the pressure application member to bend upto 45 degrees with respect to a central axis of the body member.

11. The combined mobility and stability device of claim 9, wherein the flexion portion allows the pressure application member to perform a plurality of exercises to release muscular restrictions, to increase tissue elasticity, to promote and strengthen movement patterns, and to increase proprioceptive awareness and muscular activation.

12. A method of using a combined mobility and stability device comprising a body member having a platform base formed at a first end and a semi-circular dome shaped pressure application member formed at an opposing second end, the platform base having a diameter between about 2 inches to about 12 inches, the body member having a flexion portion disposed on an outer surface of the body member between the platform base and the pressure application member, wherein the flexion portion includes a relief configured to allow the pressure application member to bend with respect to a pivot axis centered about the relief, the relief having a width of about 1 inch and a bottom of the relief disposed about 1.25 inches from the platform base, the method comprising:

placing a platform base of a first combined mobility and stability device on a surface;

placing a platform base of a second combined mobility and stability device adjacent to the first combined mobility and stability device;

placing a user's target area within a region defined by the pressure application member of the first combined mobility and stability device and the pressure application member of the second combined mobility and stability device; and performing exercises designed to release muscular restrictions, to increase tissue elasticity, and promote and strengthen movement patterns on the user's target area.

13. The method of claim 12 further comprising flipping over the first and second combined mobility and stability devices.

14. The method of claim 13 further comprising performing exercises to increase proprioceptive awareness and muscular activation on the user's target area.

* * * * *